US006685305B2

(12) United States Patent
Okuda

(10) Patent No.: US 6,685,305 B2
(45) Date of Patent: Feb. 3, 2004

(54) INK JET RECORDING HEAD AND INK JET RECORDING APPARATUS USING THIS HEAD

(75) Inventor: Masakazu Okuda, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/120,689

(22) Filed: Apr. 11, 2002

(65) Prior Publication Data

US 2002/0175976 A1 Nov. 28, 2002

(30) Foreign Application Priority Data

Apr. 11, 2001 (JP) ..... 2001-112501

(51) Int. Cl.[7] ..... B41J 2/045
(52) U.S. Cl. ..... 347/71
(58) Field of Search ..... 347/68–72, 54, 347/20; 29/25.35

(56) References Cited

U.S. PATENT DOCUMENTS 6,361,155 B1 * 3/2002 Kanda et al. ..... 347/70
6,474,780 B1 * 11/2002 Kubota et al. ..... 347/45
6,502,929 B1 * 1/2003 Tanaka et al. ..... 347/71

FOREIGN PATENT DOCUMENTS

JP 52-49034 9/1976
JP 53-12138 4/1978
JP 10-24568 1/1998
JP 2806386 7/1998
JP 10-193587 7/1998
JP 10-508808 9/1998

* cited by examiner

*Primary Examiner*—Stephen D. Meier
*Assistant Examiner*—An H. Do
(74) *Attorney, Agent, or Firm*—Scully, Scott, Murphy & Presser

(57) ABSTRACT

An ink jet recording head and an ink jet recording apparatus used this head, in which ejectors are arrayed in a two-dimensional matrix, and the necessary width of each of plural common ink branch paths is reduced, and the density arraying the ejectors is made to be high, are provided. The ink jet recording head is formed by layering and adhering a nozzle plate, a common ink path plate, an ink supplying plate, a connecting path plate, a pressure chamber plate, a vibration plate, and piezoelectric actuators. The ink supplying plate is made of a resin film whose stiffness is low. Since the ink supplying plate also works as air dampers for the plural common ink branch paths, even when the width of each of the plural common ink branch paths is made to narrow, necessary and sufficient acoustic capacitance to prevent crosstalk from generating between adjacent two ejectors can be obtained. With this structure, the density arraying the ejectors is able to be high. Further, a special plate for the air dampers is not required, therefore, the number of plates can be decreased and its manufacturing cost can be reduced.

22 Claims, 10 Drawing Sheets

(a)

(b)

INK JET RECORDING HEAD AND INK JET RECORDING APPARATUS USING THIS HEAD

BACKGROUND OF THE INVENTION

The present invention relates to an ink jet recording head and an ink jet recording apparatus used this head, which records characters and images on a recording medium by making ink drops eject from nozzles.

DESCRIPTION OF THE RELATED ART

In Japanese Patent Publication No. SHO 53-12138 and Japanese Patent Application Laid-Open No. HEI 10-193587, an ink jet recording head being a drop on demand type has been disclosed. The ink jet recording head ejects ink drops from nozzles connected to pressure chambers by making pressure waves (acoustic waves) generate in the pressure chambers in which ink was filled, by using electromechanical transducers such as piezoelectric actuators as their pressure generating means.

FIG. 1 is a sectional view showing a structure of a conventional ink jet recording head. In FIG. 1, a nozzle 52 for ejecting ink drops 57, and an ink supplying path 54, which supplies ink to a pressure chamber 51 through a common ink path 53 from an ink tank (not shown), are connected to the pressure chamber 51. The bottom surface of the pressure chamber 51 is covered with a vibration plate 55, and an air damper 58 is on the common ink path 53.

In order to make the ink drops 57 eject from the nozzle 52 connected to the pressure chamber 51, mechanical displacement is generated at the vibration plate 55 by a piezoelectric actuator 56 positioned on the outside of the vibration plate 55. And pressure waves (acoustic waves) are generated in the pressure chamber 51 by changing the volume of the pressure chamber 51 by this mechanical displacement of the vibration plate 55. With these pressure waves, a part of the ink filled in the pressure chamber 51 is ejected through the nozzle 52 and the ejected ink becomes the ink drops 57. The ink drops 57 hit a recording medium such as a piece of paper and recording dots made of the ink drops 57 are formed on the paper. By repeating this process to form the recording dots based on inputted image data, characters and images are recorded on the recording medium.

At the conventional ink jet recording head mentioned above, a parameter, which decides its recording speed, is the number of nozzles. The more the number of nozzles is, the more the number of dots, which can be formed per unit time, is, and the recording speed increases. In order to meet this requirement, in a normal type ink jet recording apparatus, a multi nozzle type recording head, in which plural ink jet mechanisms (ejectors) are connected, is used. In this, the ejector is composed of the nozzle 52, the pressure chamber 51, the vibration plate 55, the piezoelectric actuator 56, and the ink supplying path 54.

FIG. 2 is a perspective view showing a basic structure of a conventional multi nozzle type ink jet recording head. In FIG. 2, an ink tank 67 is connected to a common ink path 63 through a filter 66, and plural pressure chambers 61 are connected to this common ink path 63 through ink supplying paths (not shown), and each of the plural pressure chambers 68 provides a nozzle 62. However, at this structure, in which ejectors 68 are arrayed in a one-dimensional way, the maximum number of ejectors 68 is limited to about 100 pieces, and this number cannot be increased so largely.

In Japanese Patent No. 2806386 and Japanese Patent Application Laid-Open No. HEI 10-508808, in order to increase the number of nozzles, an ink jet recording head, in which ejectors are arrayed in a two-dimensional matrix, has been disclosed. Hereinafter this ink jet recording head is referred to as a matrix head.

FIG. 3 is a perspective view showing a basic structure of a conventional matrix head for an ink jet recording head. In FIG. 3, the common ink path is composed of a common ink main path 73 and plural common ink branch paths 78, and six ejectors are connected to each of the plural common ink branch paths 78. And ink is supplied to the common ink main path 73 from an ink tank 77 through a filter 76. This matrix head structure has a great advantage to increase the number of ejectors, in this, each of the ejectors provides a pressure chamber 71, a nozzle 72, a part of the common ink branch paths 78, a vibration plate (not shown), and a piezoelectric actuator (not shown). In FIG. 3, there are six common ink branch paths 78 and six pressure chambers 71 for each of the six common ink branch paths 78, therefore the total number of ejectors is 36. For example, when the number of the common ink branch paths 78 is 26 and 10 pressure chambers 71 are disposed in each of the common ink branch paths 78, 260 ejectors can be arrayed in the matrix head. In FIG. 3, Pn shows the distance between adjacent two ejectors, and Pc shows the distance between adjacent two common ink branch paths 78.

FIG. 4 is a diagram showing a conventional matrix head for an ink jet recording head. And in FIG. 4(*a*), a sectional view of the conventional matrix head is shown, and in FIG. 4(*b*), a plane view of the conventional matrix head is shown. This structure is shown in the Japanese Patent Application Laid-Open No. HEI 10-508808. In FIG. 4, an ink path A81 shows a common ink branch path and an ink path B88 shows a common ink main path, and an ink path plate 89 is actually formed by a multi layered structure of plural plates. In FIG. 4, an ejector is composed of a nozzle 82, a pressure chamber 83, a vibration plate 87, a piezoelectric actuator 84, and an ink supplying path 85.

FIG. 5 is a sectional view showing another conventional matrix head for an ink jet recording head. In FIG. 5, in addition to the structure shown in FIG. 4, an air damper plate 99 and an air damper 98 are provided. And in FIG. 5, a common ink branch path 91, a nozzle 92, a pressure chamber 93, a piezoelectric actuator 94, an ink supplying path 95, a nozzle plate 96, and a vibration plate 97 are further shown.

At the matrix head mentioned above, in which the ejectors are arrayed in a two-dimensional matrix, there is an advantage to increase the number of nozzles (ejectors). However, in order to realize a stable ejection of ink from nozzles at an actual matrix head, the common ink path must be designed suitably. FIG. 6 is an equivalent circuit of the conventional matrix head for the ink jet recording head. As shown in FIG. 6, each of many ejectors 101 is connected to one of common ink branch paths 102, and each of the common ink branch paths 102 is connected to a common ink main path 103. Therefore, in order to prevent that pressure wave interference (crosstalk) between ejectors 101 is generated, and also to prevent that refilling time is increased, at the time when many ejectors 101 eject ink at the same time, it is necessary to obtain large acoustic capacitance at each of the common ink branch paths 102. In this, the refilling time is the time to refill ink in nozzles after ink drops were ejected from the nozzles. In FIG. 6, "m" shows inertance $Kg/m^4$, "r" shows acoustic resistance $Ns/m^5$, "c" shows acoustic capacitance $m^5/N$, and $\phi$ shows pressure Pa. Further, each of suffixes shows as follows: "d" shows a driving section, "c" shows a pressure chamber, "i" shows an ink supplying path, "n" shows a nozzle, "p" shows a common ink branch path, and "p'" shows a common ink main path.

According to the study, when the acoustic capacitance of the common ink branch path is set to satisfy the condition $c_p > 10\ c_n$, it is possible to prevent the crosstalk from generating and the refilling time from increasing. In this, the $c_p$ is the acoustic capacitance of the common ink branch path per one ejector, and the $c_n$ is the acoustic capacitance of one nozzle. When the diameter of the nozzle is defined as $d_n$ m, and the surface tension of ink is defined as σ N/m, the $c_n$ can be approximated by an equation (1). In this, in the following equation (1), the $C_n$ shows in =.

$$c_n = \frac{\pi d_n^4}{48\sigma} \tag{1}$$

At a general ink jet recording head, the diameter of the nozzle $d_n$ is about 30 μm, the surface tension of ink σ is about 35 mN/m, consequently, the $c_n$ becomes a value about $1.5\times10^{-18}$ $m^5/N$. Therefore, it is necessary that the acoustic capacitance $c_p$ at the common ink branch path is set to be $1.5\times10^{-17}$ $m^5/N$ or more. However, it is very difficult that this value of the acoustic capacitance is obtained at the common ink branch path.

In case that the stiffness of walls of the common ink branch path is high, the acoustic capacitance $c_p$ at the common ink branch path is shown in a following equation (2). When the volume of the common ink branch path is defined as $W_p$ $m^3$, and the elastic modulus of ink is κ Pa. In this, K is a correction factor depending on the stiffness of the walls of the common ink branch path, and its value is generally about 0.3 to 0.7.

$$c_p = \frac{W_p}{\kappa \times K} \tag{2}$$

In case that the elastic modulus κ of ink is $2.2\times10^9$ Pa and K is 0.5, in order to obtain that the $c_p$ is $1.5\times10^{-17}$ $m^5/N$ or more, it is necessary that the volume Wp of the common ink branch path is $9.9\times10^{-9}$ $m^3$ or more. When it is assumed that the distance between adjacent two ejectors is 400 μm (Pn in FIG. 3) and the height of the common ink branch path is 150 μm, the requiring width of the common ink branch path becomes 260 mm or more. That is, if the walls of the common ink branch path have high stiffness, the width of the common ink branch path becomes very large. Therefore, it is impossible that the ejectors are arrayed in high density.

In order to increase the acoustic capacitance, it is necessary to provide an air damper on a part of the wall of the common ink path (refer to the air damper 58 in FIG. 1). However, there are no disclosed examples in which the air damper is attached to the common ink branch path at the matrix head. However, a multi nozzle type ink jet recording head like one shown in FIG. 2 has been disclosed in Japanese Patent Application Laid-Open No. SHO 52-49034 and Japanese Patent Application Laid-Open No. HEI 10-24568. In case that this is applied to the conventional matrix head shown in FIG. 4, the nozzle plate 86 is made of a low stiffness material and is worked as an air damper. Or as shown in FIG. 5, a structure, in which the air damper plate 99 having a part with a thin thickness is inserted and this thin thickness part is worked as the air damper 98, is used.

However, at the structure of the conventional ink jet recording head being the matrix head shown in FIGS. 4 and 5, the width of the common ink branch path cannot be set to be narrow enough. Therefore, there is a problem that the density arraying the ejectors cannot be high. This problem is explained in more detail by using numerical values.

At the structure of the conventional ink jet recording head shown in FIG. 4(*a*), the nozzle plate 86 also works as an air damper for the ink path A81 (common ink branch path). When the width of the air damper is defined as $w_d$ m, the thickness of the air damper is defined as $t_d$ m, the length of the air damper is defined as $l_d$ m, the elastic modulus of the air damper is defined as $E_d$ Pa, and the Poisson's ratio of the air damper is defined as $\nu_d$, the acoustic capacitance of the air damper $c_d$ can be approximated by an equation (3). In this, in the following equation (3), the $C_d$ shows in =.

$$c_d = \frac{l_d w_d^5 (1 - \nu_d^2)}{60 E_d t_d^3} \tag{3}$$

It is understandable from the equation (3), the acoustic capacitance of the air damper $c_d$ is in inverse proportion to the third power of the thickness of the air damper $t_d$. Therefore, in order to increase the acoustic capacitance of the air damper $c_d$, it is desirable that the thickness of the air damper td is made to be as thin as possible.

However, as mentioned above, at the structure of the conventional ink jet recording head shown in FIG. 4(*a*), the nozzle plate 86 also works as the air damper for the ink path A81 (common ink branch path). Therefore, when the thickness of the air damper is decreased, the length of the nozzle 82 is decreased. That is, there is a limit to the decrease of the thickness of the air damper. When the length of the nozzle 82 becomes short, following problems occur, that is, the ejecting direction of ink drops becomes abnormal, and the catching bubbles in the ink drops occurs. Consequently, generally, the lower limit of the length of the nozzle 82 is 20 to 50 μm. Therefore, the lower limit of the thickness of the air damper becomes 20 to 50 μm, and in order to make the acoustic capacitance of the common ink branch path $c_p$ be $1.5\times10^{-17}$ $m^5/N$ or more, even when a polyimide film having low stiffness (Ed 2.0 GPa) is used for the air damper, the width of the common ink branch path needs 0.7 to 1.5 mm. Consequently, the distance between adjacent two common ink branch paths (Pc shown in FIG. 3) becomes 1 to 2 mm, and the density arraying the ejectors cannot be high.

At the conventional ink jet recording head shown in FIG. 4(*a*), when only the part of the air damper is made to be thin, large acoustic capacitance can be obtained at the air damper without decreasing the length of the nozzle 82, however, there is a problem that the manufacturing cost is increased largely.

Further, in case that a part, whose stiffness is low, is exposed at the surface of the head (nozzle surface), when the surface of the head is wiped, a large pressure change is generated in the ink path. Therefore, there are problems that bubbles may be caught from the nozzle and also the head itself may be broken.

Therefore, at the structure of the conventional ink jet recording head shown in FIG. 4(*a*), decreasing the thickness at only the part of the air damper does not become actual solution, and it is very difficult to decrease the width of the common ink branch path. Consequently, it is very difficult that the density arraying the ejectors becomes high.

And at the structure of the conventional ink jet recording head shown in FIG. 5, the number of plates, of which the head is composed, increases, and there is a problem that the manufacturing cost becomes high.

In case that the air damper plate is made of a metal material such as stainless steel using conventionally, the common ink branch path needs a quite large width. For example, when that the air damper plate is made of stainless steel having 15 $\mu$m thickness ($E_d$=197 GPa), in order that the acoustic capacitance of the common ink branch path $c_p$ is $1.5\times10^{-17}$ $m^5/N$ or more, the common ink branch path needs about 1.8 mm width. It is possible that a resin film is used additionally for the air damper plate, however, in this case, the number of plates to be layered further increases, and the manufacturing cost of the head increases. Therefore, at the structure shown in FIG. 5, there is a problem that it is very difficult to manufacture an ink jet recording head whose density arraying the ejectors is high with low cost.

Further, at the conventional matrix head for the ink jet recording head, there is a problem that it is difficult to obtain high dimensional preciseness. At the ink jet recording head, characteristics of the ink supplying path such as inertance and acoustic resistance are important parameters to influence ink ejecting characteristics such as the volume of ink drops and ink dropping speed. Therefore, high dimensional preciseness is required at the ink supplying path.

However, at the conventional ink jet recording head, as shown in FIG. 4(*a*), the ink paths are formed by adhering plural plates. Generally, etching is applied to a metal plate to form the ink supplying path, in this case, there is a problem that dispersion about ±5 to 10 $\mu$m occurs in the width of the ink supplying path.

In case that the plates are layered by using adhesive, a part of the adhesive is stuck out in the ink paths, and there is a problem that the cross sectional area of the ink paths changes largely.

As mentioned above, at the structure of the conventional matrix head for the ink jet recording head, it is difficult that the shape of the ink supplying path has high preciseness. As a result, some dispersion occurs in the volume and the ejecting speed of ink drops that are ejected from each of the ejectors, therefore, there is a problem that the quality of the output image is deteriorated.

Further, at the conventional matrix head for the ink jet recording head, there is a problem that the ability to discharge bubbles from the pressure chamber is not high. As mentioned above, at the ink jet recording head, ink drops are ejected by the pressure waves generated in the pressure chamber. However, when bubbles remain in the pressure chamber, the pressure generating efficiency is lowered and the volume and the ejecting speed of the ink drops are decreased, and in case that the amount of the remaining bubbles is large, it becomes impossible to eject the ink drops. Therefore, at a general ink jet recording apparatus, the bubbles in the pressure chamber are removed by sucking ink from the nozzles.

However, the aspect ratio of the bottom surface of the pressure chamber at the matrix head is close to 1, and the cross sectional area of the pressure chamber is large. Consequently, it is difficult to obtain high flowing speed in the pressure chamber at the time when the ink is sucked. Especially, at the conventional matrix head shown in FIG. 4, the nozzle is positioned at the upper center part of the pressure chamber. Therefore, there is a problem that it is very difficult to discharge bubbles because the ink flow in the pressure chamber is liable to stagnate.

SUMMARY OF THE INVENTION

It is therefore an object of the present invention to provide an ink jet recording head and an ink jet recording apparatus used this head, which realizes a matrix head having high density in arraying ejectors with low manufacturing cost. Moreover, the ink jet recording head and the ink jet recording apparatus of the present invention have low dispersion at ink ejecting characteristics and are suitable for high quality recording. Furthermore, the ink jet recording head and the ink jet recording apparatus of the present invention have high ability to discharge bubbles and high reliability.

According to a first aspect of the present invention for achieving the object mentioned above, there is provided an ink jet recording head, which has plural pressure chambers, arrayed in a two-dimensional matrix and connected to plural ink supplying routes connected to plural common ink branch paths one by one through a common ink main path, and ejects ink drops from nozzles connected to the plural pressure chambers, where ink was filled through the plural ink supplying routes, one by one, by making pressure changes generate in the plural pressure chambers by using a pressure generating means. The ink jet recording head provides multi layered plates. And the multi layered plates at least include a nozzle plate for forming the nozzles, a common ink path plate for forming the common ink main path, the plural common ink branch paths, and a part of connecting paths that connect the nozzles to the plural pressure chambers one by one, an ink supplying plate for forming the ink supplying routes and a part of the connecting paths, and a pressure chamber plate for forming the plural pressure chambers. And the ink supplying plate also works as air dampers for the plural common ink branch paths.

According to a second aspect of the present invention, in the first aspect, the ink supplying plate is made of a resin film.

According to a third aspect of the present invention, in the second aspect, the thickness of the ink supplying plate is 30 $\mu$m or less.

According to a fourth aspect of the present invention, in the first aspect, the ink supplying routes are holes formed in the ink supplying plate.

According to a fifth aspect of the present invention, in the first aspect, the ink supplying routes are formed by applying a laser process to the ink supplying plate.

According to a sixth aspect of the present invention, in the first aspect, the ink jet recording head further provides a connecting path plate in which a part of the connecting paths is formed and also concave parts are formed on the surface facing the plural ink common branch paths by placing the connecting path plate between the ink supplying plate and the pressure chamber plate.

According to a seventh aspect of the present invention, in the sixth aspect, the concave parts have a shape matching with a shape of the plural common ink branch paths.

According to an eighth aspect of the present invention, in the sixth aspect, each of the concave parts is connected to the outside air through a path.

According to a ninth aspect of the present invention, in the first aspect, the nozzle plate is formed by a stainless steel plate.

According to a tenth aspect of the present invention, in the first aspect, the nozzle plate is formed by a resin film.

According to an eleventh aspect of the present invention, in the tenth aspect, the nozzle plate also works as air dampers for the plural common ink branch paths.

According to a twelfth aspect of the present invention, in the first aspect, each of the plural common ink branch paths is positioned in a state that each of the plural common ink branch paths is above some of the plural pressure chambers formed in the pressure chamber plate by placing the ink supplying plate between them.

According to a thirteenth aspect of the present invention, in the twelfth aspect, the width of each of the plural common ink branch paths is wide at the place where each of the plural common ink branch paths is not above the plural pressure chambers, and is marrow at the place where each of the plural common ink branch paths is above the plural pressure chambers.

According to a fourteenth aspect of the present invention, in the first aspect, corners of each of the pressure chambers are round corners.

According to a fifteenth aspect of the present invention, in the first aspect, walls of each of the pressure chambers have a round shape by applying both sides etching to the pressure chamber plate.

According to a sixteenth aspect of the present invention, in the first aspect, walls of each of the plural common ink branch paths have a round shape by applying both sides etching to the common ink path plate.

According to a seventeenth aspect of the present invention, in the sixth aspect, walls of each of the connecting paths have a round shape by applying both sides etching to the connecting path plate.

According to an eighteenth aspect of the present invention, in the first aspect, each of the ink supplying routes is positioned at the opposite side of each of the nozzles for each of the plural pressure chambers.

According to a nineteenth aspect of the present invention, there is provided an ink jet recording head. The ink jet recording head provides a nozzle plate being a stainless steel plate, in which nozzles for ejecting ink drops are formed, a common ink path plate, in which a part of a common ink main path, plural common ink branch paths, and a part of connecting paths are formed, an ink supplying plate, in which ink supplying holes, a part of the common ink main path, and a part of the connecting paths are formed, a connecting path plate, in which a part of the main common path, a part of the connecting paths, and concave parts are formed, and a pressure chamber plate, in which plural pressure chambers, arrayed in a two-dimensional matrix, are formed. And the nozzle plate, the common ink path plate, the ink supplying plate, the connecting path plate, and the pressure chamber plate are layered from the top in the order mentioned above on a vibration plate. And ink is supplied to each of the pressure chambers through the common ink main path, each of the plural common ink branch paths, each of the ink supplying holes, and each of the connecting paths. And each of the pressure chambers ejects ink drops from each of the nozzles through each of the connecting paths by making pressure changes generate in each of the pressure chambers by a pressure generating means. And the ink supplying plate is made of a resin film whose thickness is 30 $\mu$m or less and also works as air dampers for the plural common ink branch paths, the ink supplying holes are formed by a laser process. And the concave parts are formed on the surface facing the plural common ink branch paths through the ink supplying plate, on the connecting path plate, by having a shape matching with the shape of the plural common ink branch paths, and works as air dampers for the plural common ink branch paths, and the concave parts are connected to the outside air. And each of the plural common ink branch paths is positioned in a state that each of the plural common ink branch paths is above some of the plural pressure chambers formed in the pressure chamber plate by placing the ink supplying plate between them. The width of each of the plural common ink branch paths is wide at the place where each of the plural common ink branch paths is not above the plural pressure chambers, and is marrow at the place where each of the plural common ink branch paths is above the plural pressure chambers. And corners of each of the pressure chambers are round corners, and each of the ink supplying holes is positioned at the opposite side of each of the nozzles for each of the plural pressure chambers.

According to twentieth aspect of the present invention, there is provided an ink jet recording head. The ink jet recording head provides a nozzle plate being a resin film, in which nozzles for ejecting ink drops are formed, a common ink path plate, in which a part of a common ink main path, plural common ink branch paths, and a part of connecting paths are formed, an ink supplying plate, in which ink supplying holes, a part of the common ink main path, and a part of the connecting paths are formed, a connecting path plate, in which a part of the main common path, a part of the connecting paths, and concave parts are formed, and a pressure chamber plate, in which plural pressure chambers, arrayed in a two-dimensional matrix, are formed. And the nozzle plate, the common ink path plate, the ink supplying plate, the connecting path plate, and the pressure chamber plate are layered from the top in the order mentioned above on a vibration plate. Ink is supplied to each of the pressure chambers through the common ink main path, each of the plural common ink branch paths, each of the ink supplying holes, and each of the connecting paths. And each of the pressure chambers ejects ink drops from each of the nozzles through each of the connecting paths by making pressure changes generate in each of the pressure chambers by a pressure generating means. And the ink supplying plate is made of a resin film whose thickness is 30 $\mu$m or less and also works as air dampers for the plural common ink branch paths. And the ink supplying holes are formed by a laser process. The concave parts are formed on the surface facing the plural common ink branch paths through the ink supplying plate, on the connecting path plate, by having a shape matching with the shape of the plural common ink branch paths, and works as air dampers for the plural common ink branch paths, and the concave parts are connected to the outside air. And the nozzle plate also works as air dampers for the plural common ink branch paths, and each of the plural common ink branch paths is positioned in a state that each of the plural common ink branch paths is above some of the plural pressure chambers formed in the pressure chamber plate by placing the ink supplying plate between them. The width of each of the plural common ink branch paths is wide at the place where each of the plural common ink branch paths is not above the plural pressure chambers, and is marrow at the place where each of the plural common ink branch paths is above the plural pressure chambers. Corners of each of the pressure chambers are round corners, walls of each of the pressure chambers have a round shape by applying both sides etching to the pressure chamber plate, walls of each of the plural common ink branch paths have a round shape by applying both sides etching to the common ink path plate and walls of each of the connecting paths have a round shape by applying both sides etching to the connecting path plate. And each of the ink supplying holes is positioned at the opposite side of each of the nozzles for each of the plural pressure chambers.

According to a twenty-first aspect of the present invention, there is provided an ink jet recording apparatus. The ink jet recording apparatus provides the ink jet recording head mentioned at the nineteenth aspect.

According to a twenty-second aspect of the present invention, there is provided an ink jet recording apparatus.

The ink jet recording apparatus provides the ink jet recording head mentioned at the twentieth aspect.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 7:
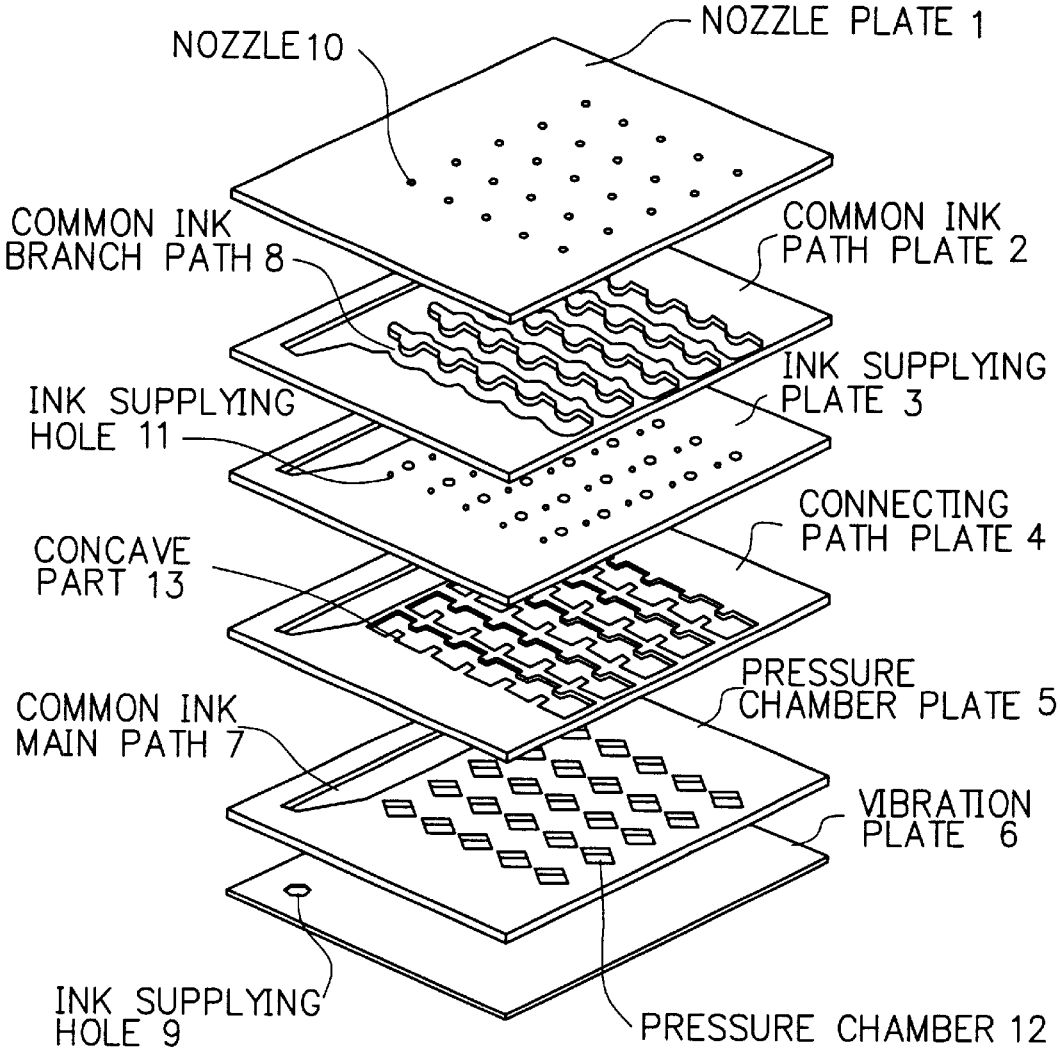
FIG. 7 is a perspective view showing a plate structure of an ink jet recording head at a first embodiment of the present invention.

Referring now to the drawings, embodiments of the present invention are explained in detail. FIG. 7 is a perspective view showing a plate structure of an ink jet recording head at a first embodiment of the present invention. Referring to FIG. 7, the first embodiment of the present invention is explained.

In FIG. 7, an ink flowing path in the ink jet recording head at the first embodiment of the present invention is formed by that a nozzle plate 1, a common ink path plate 2, an ink supplying plate 3, a connecting path plate 4, a pressure chamber plate 5, and a vibration plate 6 are layered and adhered by an adhesive.

A common ink path is composed of a common ink main path 7 and five common ink branch paths 8. The common ink main path 7 is connected to an ink tank (not shown) through an ink supplying hole 9, and supplies ink to the five common ink branch paths 8. Five pressure chambers 12 are connected to each of the five common ink branch paths 8. That is, the ink jet recording head at the first embodiment of the present invention provides 25 ejectors. However, in case that 26 common ink branch paths 8 and 10 pressure chambers 12 in each of the common ink branch paths 8 are provided, the ink jet recording head can provide 260 ejectors. Therefore, the number of ejectors is not limited to the number mentioned above. In this, each of the ejectors provides a nozzle 10, one common ink branch path 8, an ink supplying hole 11, a concave part 13, the pressure chamber 12, a part of the vibration plate 6, and a piezoelectric actuator (not shown).

Figure 8:
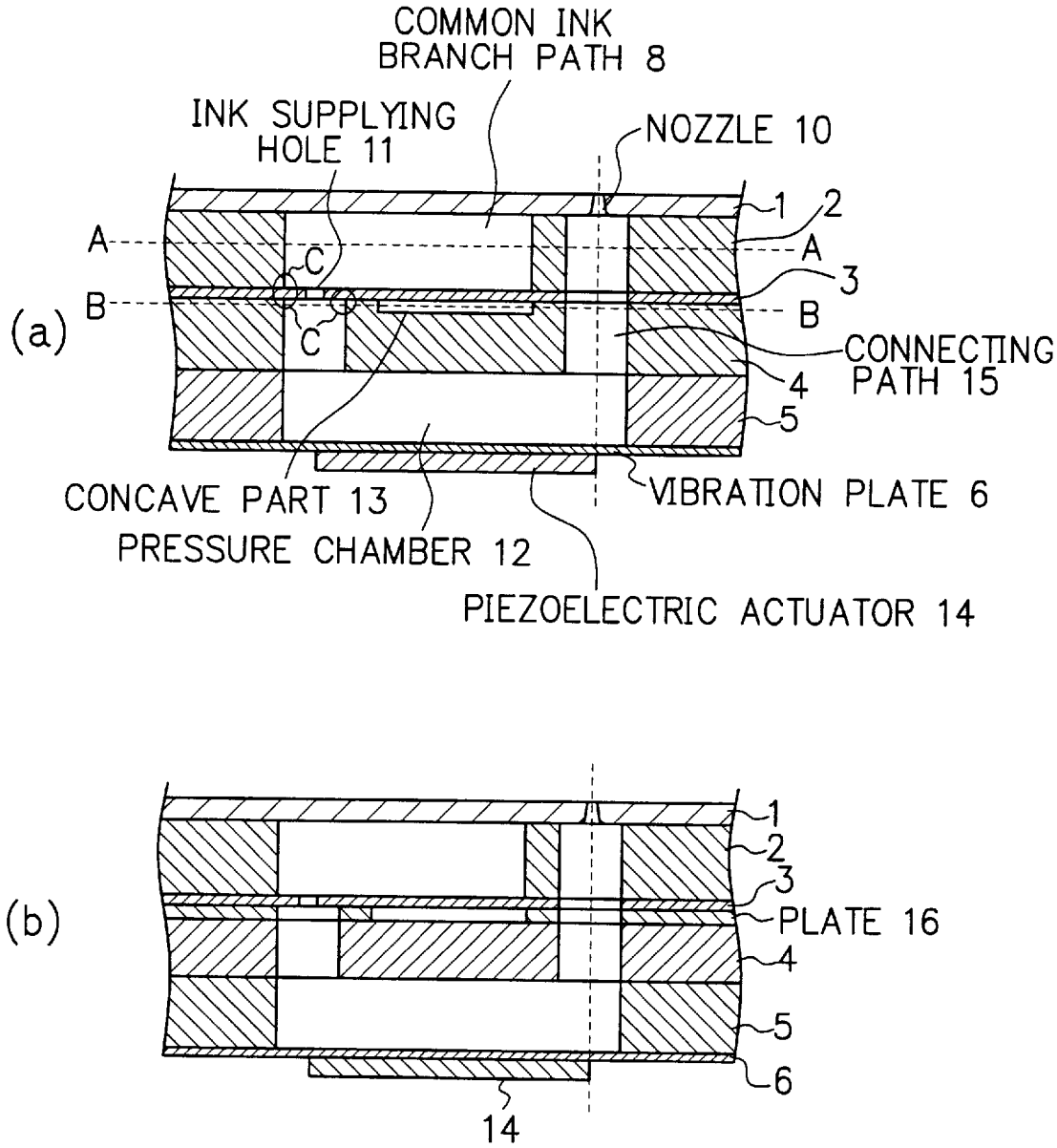
FIG. 8 is a sectional view showing an ejector in the ink jet recording head at the first embodiment of the present invention.

FIG. 8 is a sectional view showing the ejector in the ink jet recording head at the first embodiment of the present invention. In FIG. 8(*a*), the pressure chamber 12 is connected to the common ink branch path 8 through the ink supplying hole 11, and ink is filled in the pressure chamber 12. The nozzle 10, from which ink drops are ejected, is connected to the pressure chamber 12 through a connecting path 15. The bottom of the pressure chamber 12 is covered with the vibration plate 6, and a piezoelectric actuator 14 is fixed on the outside surface of the vibration plate 6 as a pressure generating means. The number of the piezoelectric actuators 14 is equal to the number of the pressure chambers 12. This piezoelectric actuator 14 is bent, when a driving voltage waveform is applied, and makes the pressure chamber 12 expand or compress. With this, the volume of the pressure chamber 12 is changed, and pressure waves are generated in the pressure chamber 12. The ink in the nozzle 10 is moved by the force of the pressure waves, and the ink drops are flown to the outside from the nozzle 10.

At the first embodiment of the present invention, a stainless steel plate of 60 $\mu$m thickness was used for the nozzle plate 1, and the nozzle 10 having an opening hole of 25 $\mu$m diameter was formed by applying a pressing process to the nozzle plate 1.

The ink supplying plate 3 was made of a polyimide film having 12.5 $\mu$m thickness ($E_d$=2.0 GPa, $\nu_d$=0.4), and the ink supplying holes 111 whose opening diameter is 26 $\mu$m were formed by applying an excimer laser process. And also the connecting paths 15 were formed in the ink supplying plate 3. This ink supplying plate 3 also works as air dampers for the common ink branch paths 8. The air damper is explained later. In order to obtain large capacitance at the air damper, it is desirable that the thickness of the ink supplying plate 3 is 30 $\mu$m or less.

The common ink path plate 2 and the connecting path plate 4 were made of a stainless steel plate having 150 $\mu$m thickness, and their ink path patterns were formed by etching. And the pressure chambers 12 were formed in the pressure chamber plate 5 made of a stainless steel plate having 150 $\mu$m thickness, by etching.

At the pressure chamber 12, the length of one side is about 300 $\mu$m, and its shape is nearly square whose aspect ratio is almost one. In order to discharge bubbles easily from the pressure chamber 12, corner parts of the pressure chamber 12 were made to be round corners.

In the connecting path plate 4, the concave parts 13 were formed by half etching, at the part facing each of the common ink branch paths 8. When the ink supplying plate 3 and the connecting path plate 4 were layered, these concave parts 13 become cavities between them, and the ink supplying plate 3 can work as the air dampers by these concave parts 13.

In this, as shown in FIG. 8(*b*), without providing the concave parts 13 in the connecting path plate 4, by additionally adhering a plate 16 to the ink supplying plate 3 and the connecting path plate 4, almost the same structure as the concave parts 13 have can be obtained. However, as the first embodiment of the present invention, in case that the concave parts 13 are formed in the connecting path plate 4 by half etching, the number of plates of which the head is composed can be reduced. Therefore, it is an advantage to make its manufacturing cost low. Further, in FIG. 8(*a*), a connecting path (not shown), which connects each of the concave part 13 to the outside air, is provided at the concave part 13. With this structure, the air pressure in the cavity formed by the concave part 13 always becomes the same air pressure of the outside air. With this, the air damper function can be improved, and the plate layering and adhering process can be made to be easy at the head manufacturing, because there is no airtight space.

As shown in FIG. 8(*a*), the common ink branch path 8 is disposed over the pressure chamber 12. With this structure, compared with a structure in which a common ink branch path and a pressure chamber are disposed in the same plane, the width of the common ink branch path 8 can be widen, and a small sized ink jet recording head can be realized. That is, at the first embodiment of the present invention, the ejectors can be arrayed in high density.

Figure 9:
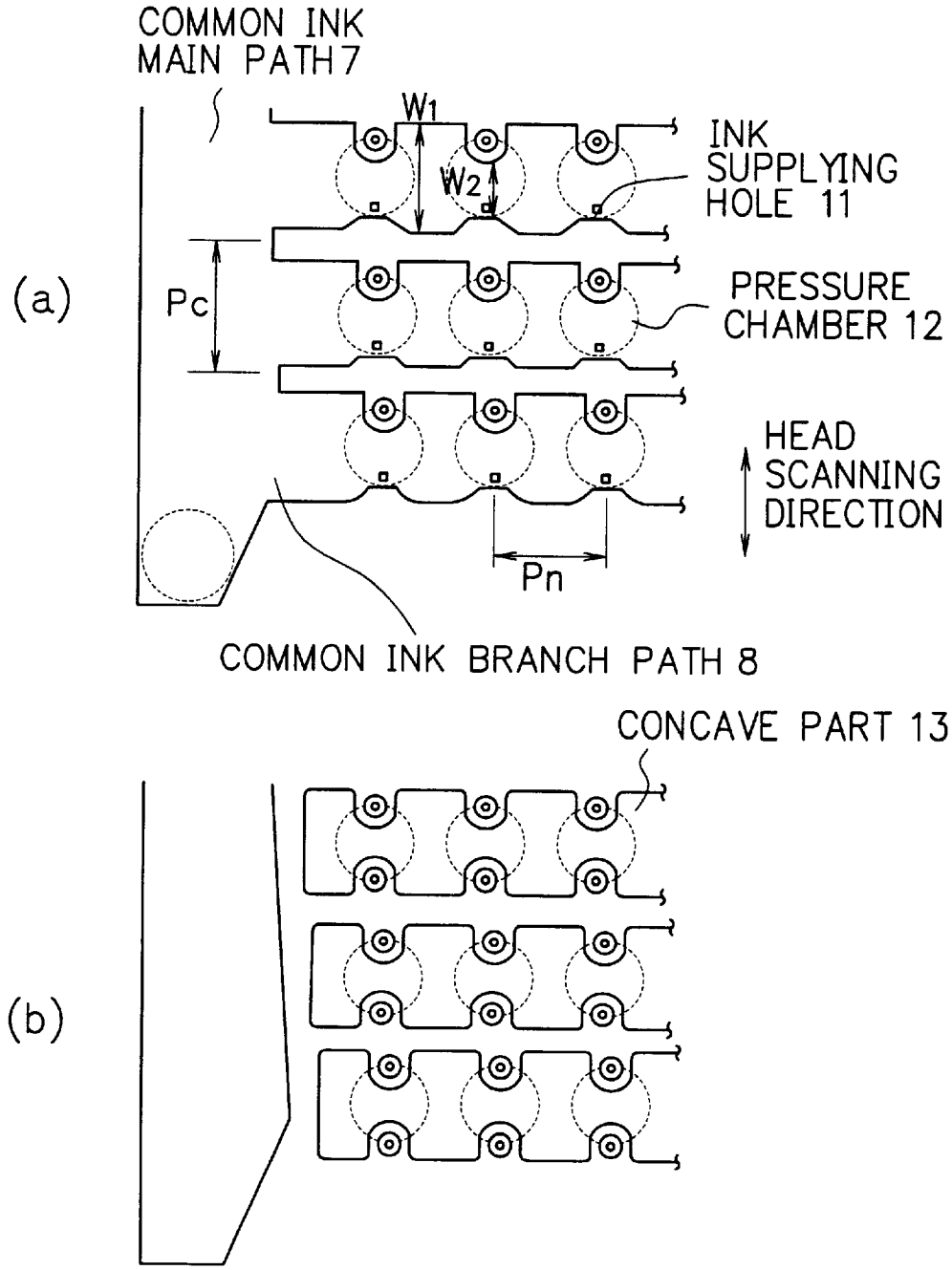
FIG. 9 is a plane view showing a part of the ejector in the ink jet recording head shown in FIG. 8.

FIG. 9 is a plane view showing a part of the ejector in the ink jet recording head shown in FIG. 8. In FIG. 9(*a*), a plane view at the A—A line shown in FIG. 8(*a*) is shown. And in FIG. 9(*b*) a plane view at the B—B line shown in FIG. 8(*a*) is shown. As shown in FIG. 9(*a*), the width of the common ink branch path 8 becomes the maximum value $W_1$ at the place between the adjacent two pressure chambers 12 and becomes the minimum value $W_2$ at the place where the common ink branch path 8 is over the pressure chamber 12. That is, the width of the common ink branch path 8 is narrowed at the minimum value $W_2$. When the common ink branch path 8 has a shape in which some parts of it are narrowed, the acoustic capacitance of the common ink branch path 8 can be made to be maximum, and a small sized ink jet recording head can be realized and the ejectors can be arrayed in high density. As shown in FIG. 9(*b*), the concave part 13 also has a shape in which some parts of it are narrowed, matching with the shape of the common ink branch path 8.

In the ink jet recording head at the first embodiment of the present invention, the maximum width $W_1$ of the common ink branch path 8 is set to be 420 $\mu$m and the minimum width $W_2$ of the common ink branch path 8 is set to be 180 $\mu$m, and the distance between adjacent two ejectors Pn is set to be 400 $\mu$m. On the bottom surface of the common ink branch paths 8, the ink supplying plate 3 whose stiffness is low is disposed, and the parts of the ink supplying plate 3, contacting with the common ink branch paths 8, works as air dampers. The acoustic capacitance $c_p$ ($\approx c_d$) at the common ink branch path 8 per one ejector becomes $1.9\times10^{-17}$ $m^5/N$, from the equation (3) mentioned above. The acoustic capacitance of the nozzle 10 $c_n$ is $7.3\times10^{-19}$ $m^5/N$ ($d_n$=25 $\mu$m, $\sigma$=35 mN/m), therefore, the $c_p$ becomes 26 times the $c_n$, and sufficient acoustic capacitance can be obtained at the common ink branch path 8. At the first embodiment of the present invention, the nozzle plate 1 was made of a stainless steel plate having 60 $\mu$m thickness ($E_d$=197 GPa), therefore, the nozzle plate 1 hardly works as the air damper. In this, the acoustic capacitance of the nozzle plate 1 is $1.7\times10^{-21}$ $m^5/N$.

The vibration plate 6 was made of a stainless steel plate having 10 $\mu$m thickness. The piezoelectric actuator 14 was made of a single plate type piezoelectric ceramics having 30 $\mu$m thickness.

In the ink jet recording head at the first embodiment of the present invention, the volume of ink drops, the ink drop speed, and the refilling time were measured while the ejecting frequency and the number of ejectors at the same time ejecting were changed. As the result of the measurement, the dispersion of the volume of ink drops and the ink drop speed were in a range within ±2%, and also the dispersion of the refilling time was in a range within ±2 $\mu$s. Consequently, it was confirmed that generating the crosstalk and increasing the refilling time were prevented.

As mentioned above, at the first embodiment of the present invention, the ink supplying plate 3 was made of a resin material having low stiffness, and was also worked as the air damper for each of the common ink branch paths 8. With this, necessary and sufficient acoustic capacitance was able to be obtained at the common ink branch path 8 whose maximum width $W_1$ was 420 $\mu$m being narrow. Further, the common ink branch paths 8 were disposed over the pressure chambers 12, and the shape of the common ink branch paths 8 had some narrow parts. Consequently, the distance between the adjacent two common ink branch paths 8 Pc was able to be about 650 $\mu$m being small. As a result, 260 ejectors were able to be disposed in a small area 4×17 $mm^2$, and the density of ejectors became 1.5 to 3.0 times that of the conventional multi head shown in FIGS. 4 and 5.

Further, at the first embodiment of the present invention, the ink supplying holes 11 were formed by that the excimer laser process was applied to the polyimide film (the ink supplying plate 3), therefore, the preciseness of the size of the ink supplying holes 11 was able to be obtained. That is, it is possible to obtain the preciseness of ±0.5 to 1.0 $\mu$m for the ink supplying holes 11 by applying the excimer laser process. And even when an adhesive is used for layering plates, places being sufficient for the stuck out adhesive were able to be obtained at C parts shown in FIG. 8, therefore, the cross sectional area of the ink supplying holes 11 was not changed by the adhesive. In the ink jet recording head at the first embodiment of the present invention, the dispersion of the volume of ink drops and the dispersion of the ink drop speed at all of the ejectors were measured, and it was confirmed that the respective dispersion was ±3% or less. At the conventional ink jet recording head structure shown in FIGS. 4 and 5, the dispersion of the volume of ink drops and the dispersion of the ink drop speed were about ±10 to 20% respectively. Therefore, the ink jet recording head at the first embodiment of the present invention has an advantage that makes the ink ejecting characteristics uniform at the ejectors.

At the first embodiment of the present invention, as shown in FIG. 8, the ink supplying hole 11 is positioned at the opposite side of the pressure chamber 12 for the nozzle 10. With this, the ink flowing direction in the pressure chamber 12 at ink sucking time becomes one direction, and the stagnation of ink in the pressure chamber 12 is not generated, and bubble discharging ability can be increased largely. In the actual measured result at ink filling time, bubbles in all of the pressure chambers 12 were discharged by sucking ink for 5 seconds at the sucking pressure of 200 mmHg.

Figure 1:
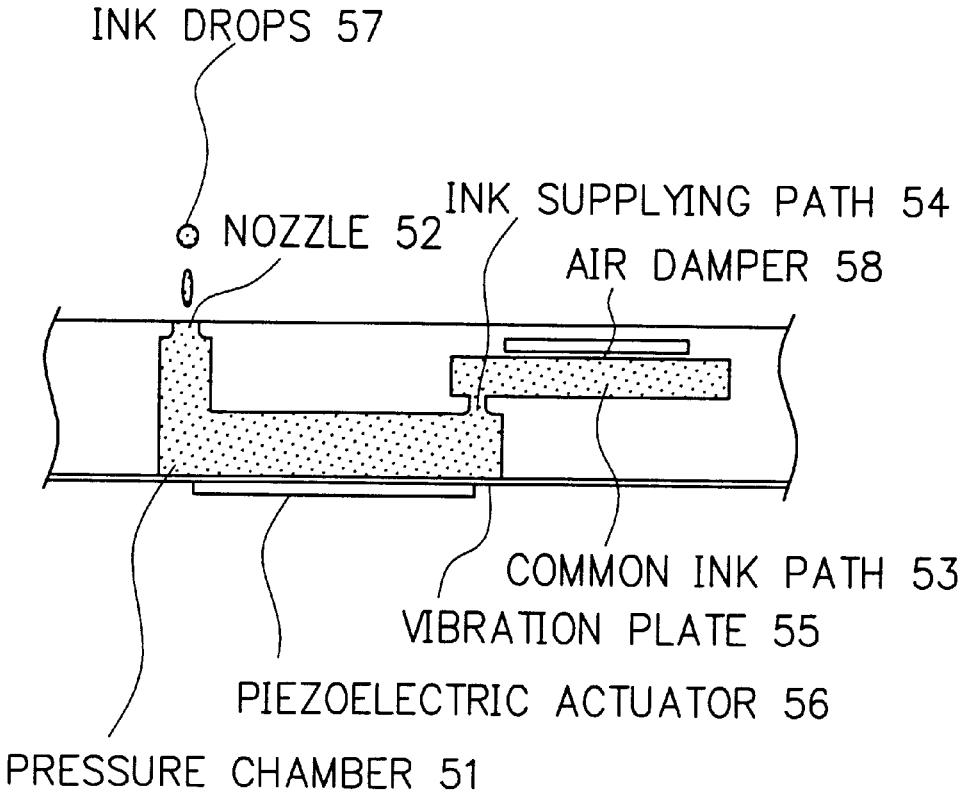
FIG. 1 PRIOR ART
FIG. 1 is a sectional view showing a structure of a conventional ink jet recording head.
Figure 2:
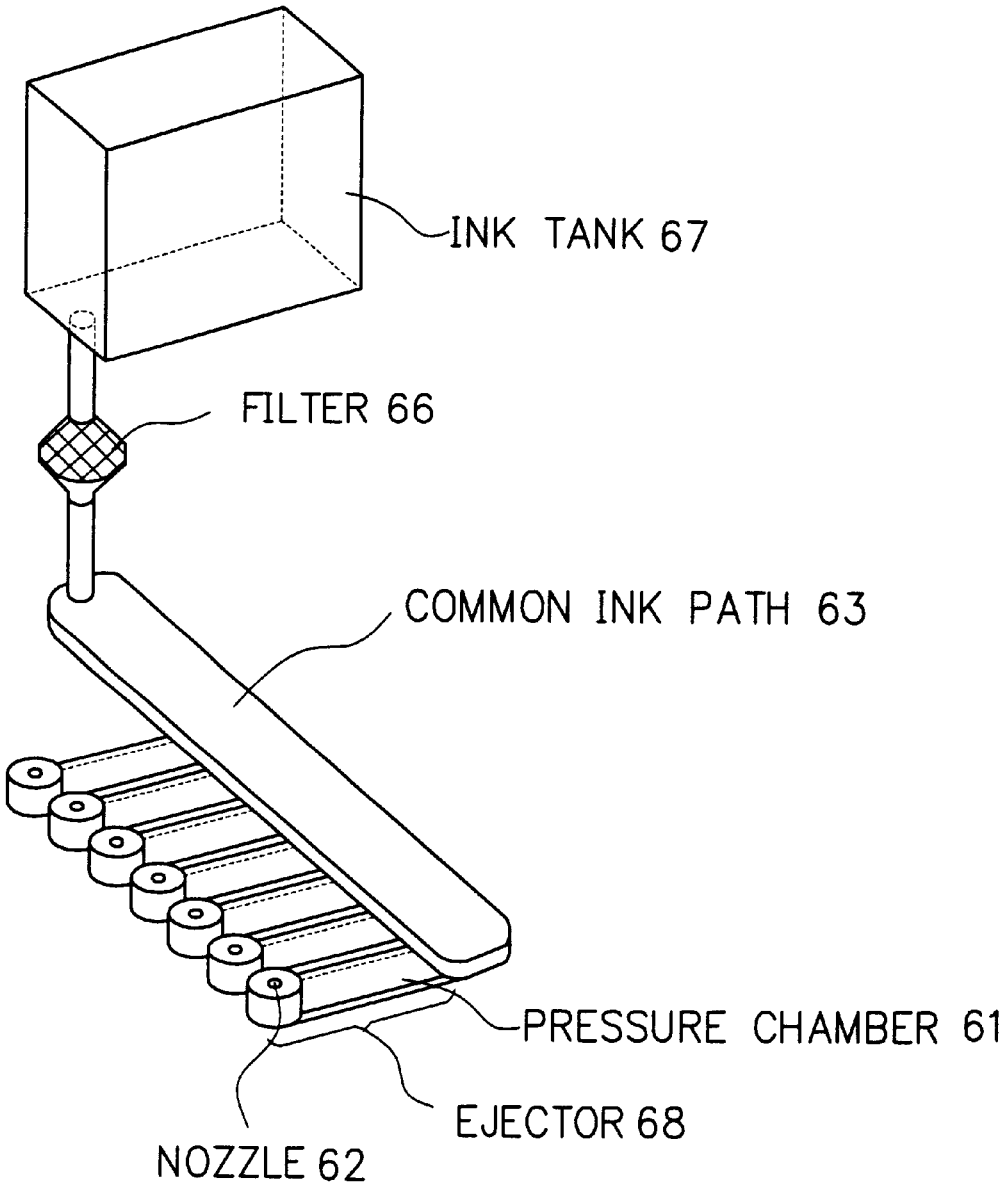
FIG. 2 PRIOR ART
FIG. 2 is a perspective view showing a basic structure of a conventional multi nozzle type ink jet recording head.
Figure 3:
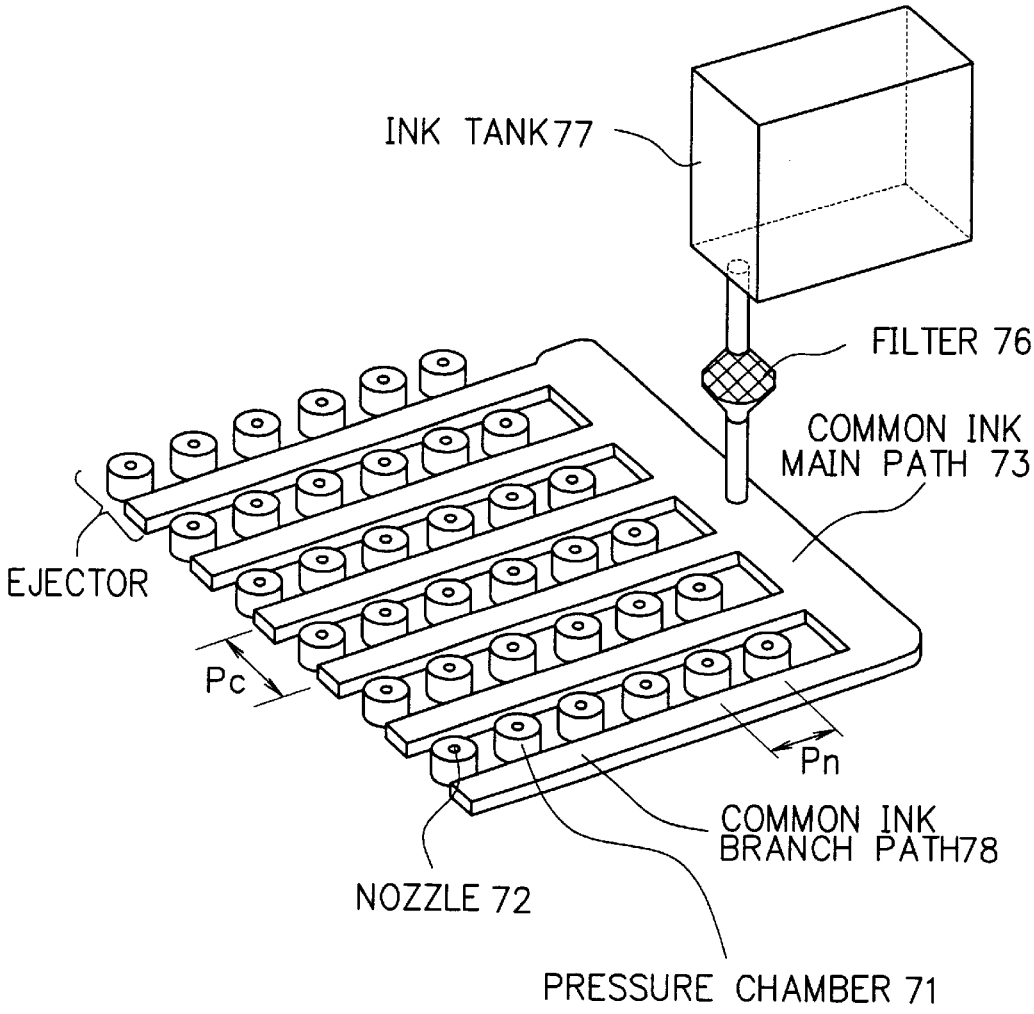
F I G. 3 PRIOR ART
FIG. 3 is a perspective view showing a basic structure of a conventional matrix head for an ink jet recording head.
Figure 4:
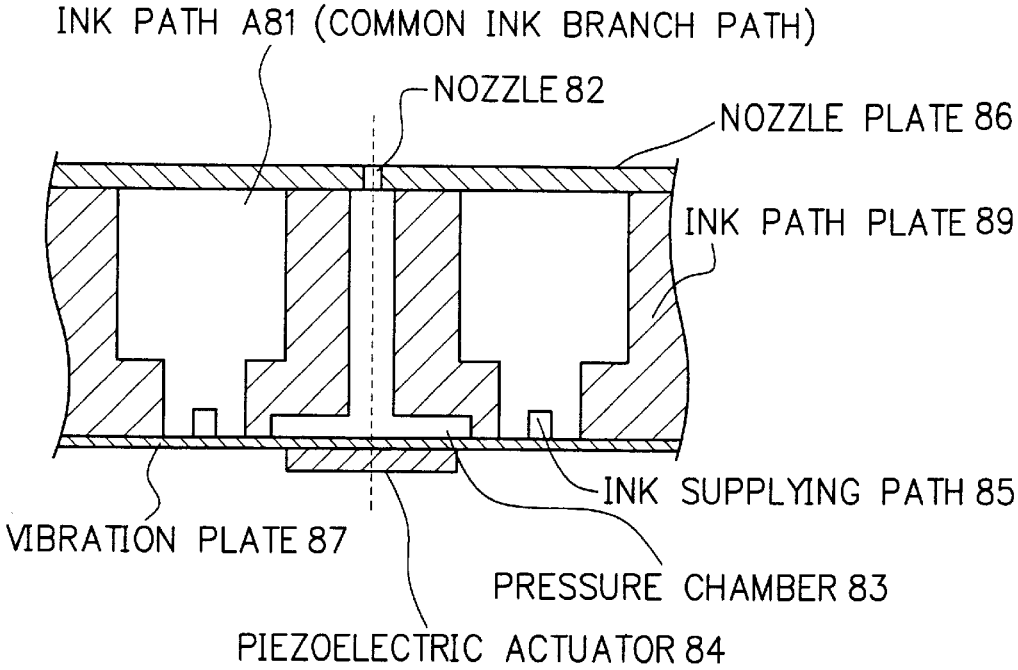
FIG. 4 PRIOR ART
FIG. 4 is a diagram showing a conventional matrix head for an ink jet recording head.
Figure 4:
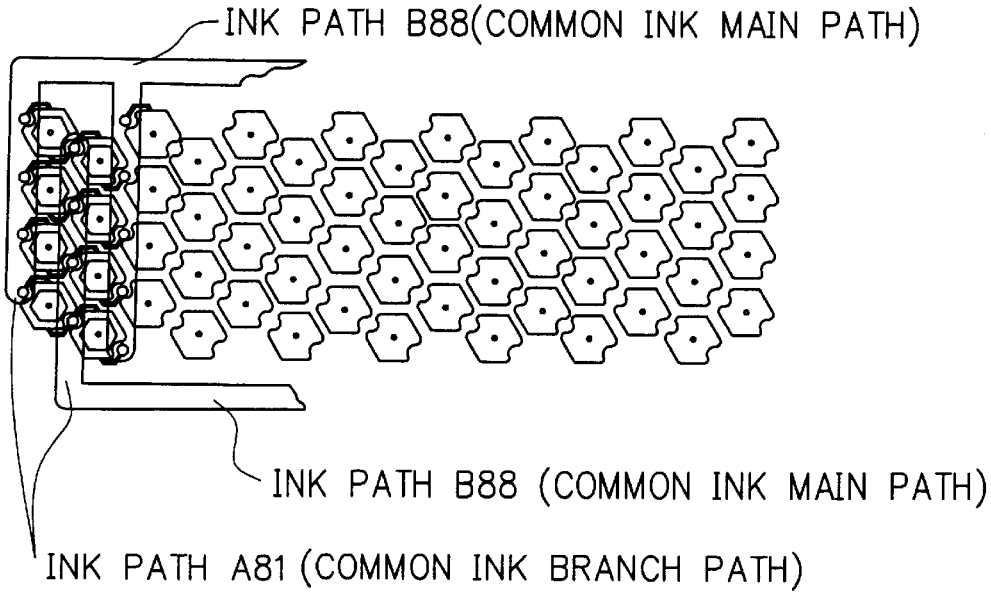
FIG. 4 PRIOR ART
Figure 5:
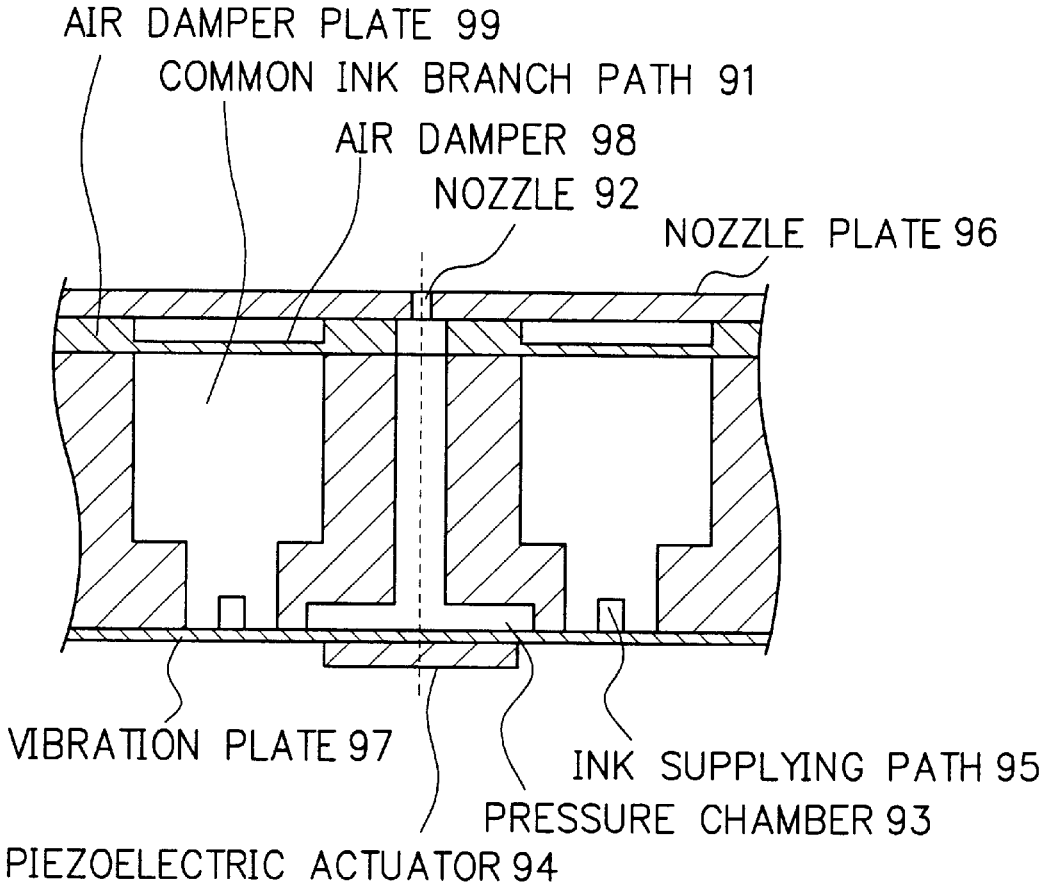
FIG. 5 PRIOR ART
FIG. 5 is a sectional view showing another conventional matrix head for an ink jet recording head.
Figure 6:
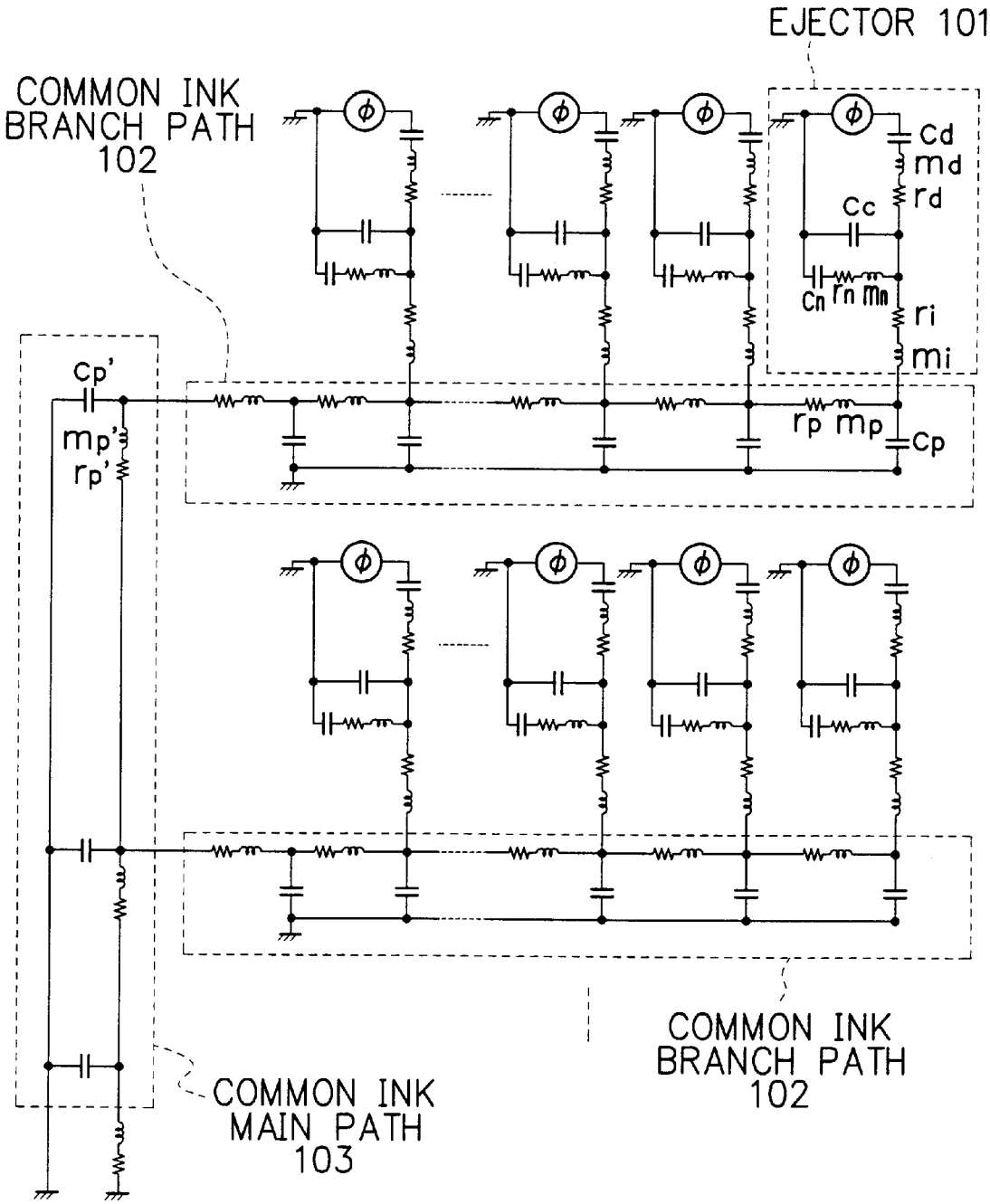
FIG. 6 PRIOR ART
FIG. 6 is an equivalent circuit of a conventional matrix head for an ink jet recording head.

At the conventional ink jet recording head shown in FIG. 4, even when the sucking time was made to be longer at the sucking pressure of 200 mmHg, all of the remaining bubbles were not discharged. And all of the remaining bubbles were finally discharged by sucking for about 3 minutes at the sucking pressure of 350 mmHg.

As mentioned above, in the ink jet recording head at the first embodiment of the present invention, it is easy that the ink supplying hole 11 and the nozzle 10 are positioned at respective opposite places each other for the pressure chamber 12, therefore, the bubble discharging ability can be made to be high.

Figure 10:
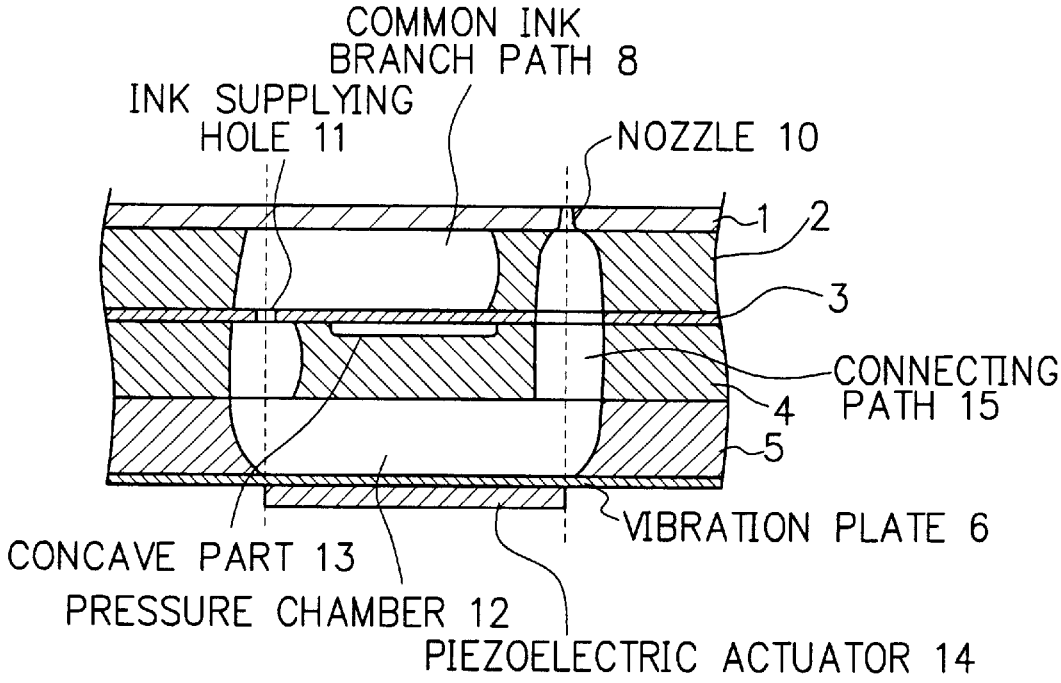
FIG. 10 is a sectional view showing a structure of an ink jet recording head at a second embodiment of the present invention.

Next, referring to the drawing, a second embodiment of the present invention is explained. FIG. 10 is a sectional view showing a structure of an ink jet recording head at the second embodiment of the present invention. The basic structure of the ink jet recording head at the second embodiment is the same as that at the first embodiment has. However, at the second embodiment, a resin film having low stiffness is used for the nozzle plate 1, instead of the stainless steel, and walls of ink paths have a round shape.

At the second embodiment, in case that a material having low stiffness is used for the nozzle plate 1, the nozzle plate 1 can also work as air dampers for the common ink branch paths 8. Consequently, on both surfaces (upper surface and bottom surface) of the common ink branch paths 8, air dampers are given, and larger acoustic capacitance of the common ink branch paths 8 can be obtained more easily. At the second embodiment, a polyimide film having 20 $\mu$m thickness was used for the nozzle plate 1, and the nozzles 10 were formed by the excimer laser process.

In the ink jet recording head at the second embodiment of the present invention, the maximum width $W_1$ of the common ink branch path 8 was set to be 400 $\mu$m and the minimum width $W_2$ of the common ink branch path 8 was set to be 180 $\mu$m. And the acoustic capacitance of $1.7\times10^{-17}$ $m^5/N$ was obtained from the air damper of the bottom surface (the ink supplying plate 3) and the acoustic capacitance of $2.0\times10^{-18}$ $m^5/N$ was obtained from the air damper of the upper surface (the nozzle plate 1), and the total acoustic capacitance of $1.9\times10^{-17}$ $m^5/N$ was obtained. That is, at the second embodiment, the acoustic capacitance being equal to that at the first embodiment can be obtained by that the maximum width $W_1$ is 20 $\mu$m smaller than that at the first embodiment.

Further, at the second embodiment, since the width of the common ink branch path 8 was decreased, the distance between the adjacent two common ink branch paths 8 was able to be about 640 $\mu$m, which is 10 $\mu$m smaller than that at the first embodiment. Consequently, the density arraying ejectors can be increased by about 3%, compared with at the first embodiment.

In the ink jet recording head at the second embodiment of the present invention, the volume of ink drops, the ink drop speed, and the refilling time were measured while the ejecting frequency and the number of ejectors at the same time ejecting were changed. As the result of the measurement, the dispersion of the volume of ink drops and the dispersion of the ink drop speed were in a range within ±2% respectively, and the dispersion of the refilling time was in a range within ±2 $\mu$s, as the same as at the first embodiment. And it was confirmed that sufficient acoustic capacitance was obtained at the common ink branch paths 8.

Further, in the ink jet recording head at the second embodiment of the present invention, as shown in FIG. 10, the walls of ink paths have a round shape intentionally, by applying both sides etching to the pressure chamber plate 5, the common ink path plate 2, and the connecting path plate 4. With the round shaped walls of the ink paths, the ink can flow smoother in the ink paths, and the ability discharging bubbles can be improved further. In the actual measured result at ink filling time, bubbles in all of the pressure chambers 12 were discharged by sucking ink for 5 seconds at the sucking pressure of 150 mmHg.

The present invention is not limited to the embodiments mentioned above, and the embodiments can be modified within the concept of the present invention. For example, a piezoelectric actuator was used as a pressure generating means at the embodiments. However, as the pressure generating means, other pressure generating means such as an electromechanical transducer utilizing static electric force or magnetic force, and an electrothermal energy converter, which generates pressure by using a boiling phenomenon, can be used. And as the piezoelectric actuator, a single plate type piezoelectric actuator was used at the embodiments. However, other type actuators such as a multi layered type piezoelectric actuator that vibrates vertically can be used as the piezoelectric actuator.

Further, at the embodiments of the present invention, stainless steel was used to form the common ink paths and the pressure chambers, however, other materials such as ceramics and glass can be used for the common ink paths and the pressure chambers.

And at the embodiments of the present invention, the shape of the pressure chamber was a square or a rectangle, however, the shape can be a circle or a hexagon.

At the embodiments of the present invention, the common ink branch paths were positioned to be perpendicular to the head scanning direction, and the common ink main path was positioned to be parallel to the head scanning direction. However, the positioning the ink paths is not limited to the embodiments. For example, the common ink branch paths can be positioned to be parallel to the head scanning direction, and the common ink main path can be positioned to be perpendicular to the head scanning direction. And at the embodiments of the present invention, plural common ink branch paths were connected to one common ink main path, however, the common ink main path can be divided into plural paths.

Further, at the embodiments of the present invention, the ink jet recording apparatus, in which several kinds of color ink are hit on a piece of recording paper and characters and images are recorded on the paper, was explained. However, the ink jet recording apparatus of the present invention is not limited to recording the characters and the images on the paper. That is, a recording medium is not limited to paper, and also liquid hitting the recording medium is not limited to color ink. For example, color filters for a display can be formed by making the color ink hit on a polymer film or glass, and solder bumps for mounting components can be formed on a printed circuit board (PCB) by making melted solder hit on the PCB. That is, the present invention can be used for a liquid drop ejecting apparatus that is used in industries.

As mentioned above, according to the present invention, compared with the conventional ink jet recording head, in which air dampers for common ink branch paths are formed by a nozzle plate or a special air damper plate, air dampers are formed by a ink supplying plate at the present invention. With this structure, large acoustic capacitance at the common ink branch paths can be obtained by layering small number of plates. And a matrix head having large number of ejectors can be realized in a small size and at a low cost.

Moreover, according to the present invention, ink supplying holes are formed in an ink supplying plate, therefore, a matrix head, in which high dimensional preciseness is kept for the ink supplying paths and the uniformity of ink ejecting characteristics is excellent, can be realized.

Furthermore, according to the present invention, the ink supplying hole can be positioned at the opposite side of the nozzle for the pressure chamber, therefore, high ability discharging bubbles can be obtained, and a matrix head whose reliability is high can be realized.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. An ink jet recording head, which has plural pressure chambers, arrayed in a two-dimensional matrix and connected to plural ink supplying routes connected to plural common ink branch paths one by one through a common ink main path, and ejects ink drops from nozzles connected to said plural pressure chambers, where ink was filled through said plural ink supplying routes, one by one, by making pressure changes generate in said plural pressure chambers by using a pressure generating means, comprising:

multi layered plates, wherein:

said multi layered plates at least include a nozzle plate for forming said nozzles, a common ink path plate for forming said common ink main path, said plural common ink branch paths, and a part of connecting paths that connect said nozzles to said plural pressure chambers one by one, an ink supplying plate for forming said ink supplying routes and a part of said connecting paths, and a pressure chamber plate for forming said plural pressure chambers, and a connecting path plate between said ink supplying plate and said pressure chamber plate, wherein:

said ink supplying plate also works as air dampers for said plural common ink branch paths.

2. An ink jet recording head in accordance with claim 1, wherein:

said ink supplying plate is made of a resin film.

3. An ink jet recording head in accordance with claim 2, wherein:

the thickness of said ink supplying plate is 30 $\mu$m or less.

4. An ink jet recording head in accordance with claim 1, wherein:

said ink supplying routes are holes formed in said ink supplying plate.

5. An ink jet recording head in accordance with claim 1, wherein:

said ink supplying routes are formed by applying a laser process to said ink supplying plate.

6. An ink jet recording head in accordance with claim 1, wherein a part of said connecting paths is formed in said connecting path plate and also concave parts are formed on the surface of said connecting path plate facing said plural ink common branch paths.

7. An ink jet recording head in accordance with claim 6, wherein:

said concave parts have a shape matching with a shape of said plural common ink branch paths.

8. An ink jet recording head in accordance with claim 6, wherein:

each of said concave parts is connected to the outside air through a path.

9. An ink jet recording head in accordance with claim 6, wherein:

walls of each of said connecting paths have a round shape by applying both sides etching to said connecting path plate.

10. An ink jet recording head in accordance with claim 1, wherein:

said nozzle plate is formed by a stainless steel plate.

11. An ink jet recording head in accordance with claim 1, wherein:

said nozzle plate is formed by a resin film.

12. An ink jet recording head in accordance with claim 11, wherein:

said nozzle plate also works as air dampers for said plural common ink branch paths.

13. An ink jet recording head in accordance with claim 1, wherein:

each of said plural common ink branch paths is positioned in a state that each of said plural common ink branch paths is above some of said plural pressure chambers formed in said pressure chamber plate by placing said ink supplying plate between them.

14. An ink jet recording head in accordance with claim 11, wherein:

the width of each of said plural common ink branch paths is wide at the place where each of said plural common ink branch paths is not above said plural pressure chambers, and is narrow at the place where each of said plural common ink branch paths is above said plural pressure chambers.

15. An ink jet recording head in accordance with claim 1, wherein:

corners of each of said pressure chambers are round corners.

16. An ink jet recording head in accordance with claim 1, wherein:

walls of each of said pressure chambers have a round shape by applying both sides etching to said pressure chamber plate.

17. An ink jet recording head in accordance with claim 1, wherein:

walls of each of said plural common ink branch paths have a round shape by applying both sides etching to said common ink path plate.

18. An ink jet recording head in accordance with claim 1, wherein:

each of said ink supplying routes is positioned at the opposite side of each of said nozzles for each of said plural pressure chambers.

19. An ink jet recording head, comprising:

a nozzle plate being a stainless steel plate, in which nozzles for ejecting ink drops are formed;

a common ink path plate, in which a part of a common ink main path, plural common ink branch paths, and a part of connecting paths are formed;

an ink supplying plate, in which ink supplying holes, a part of said common ink main path, and a part of said connecting paths are formed;

a connecting path plate, in which a part of said main common path, a part of said connecting paths, and concave parts are formed; and a pressure chamber plate, in which plural pressure chambers, arrayed in a two-dimensional matrix, are formed, wherein:

said nozzle plate, said common ink path plate, said ink supplying plate, said connecting path plate, and said pressure chamber plate are layered from the top in the order mentioned above on a vibration plate, ink is supplied to each of said pressure chambers through said common ink main path, each of said plural common ink branch paths, each of said ink supplying holes, and each of said connecting paths, each of said pressure chambers ejects ink drops from each of said nozzles through each of said connecting paths by making pressure changes generate in each of said pressure chambers by a pressure generating means, wherein:

said ink supplying plate is made of a resin film whose thickness is 30 $\mu$m or less and also works as air dampers for said plural common ink branch paths, said ink supplying holes are formed by a laser process, said concave parts are formed on the surface facing said plural common ink branch paths through said ink supplying plate, on said connecting path plate, by having a shape matching with the shape of said plural common ink branch paths, and works as air dampers for said plural common ink branch paths, and said concave parts are connected to the outside air, each of said plural common ink branch paths is positioned in a state that each of said plural common ink branch paths is above some of said plural pressure chambers formed in said pressure chamber plate by placing said ink supplying plate between them, the width of each of said plural common ink branch paths is wide at the place where each of said plural common ink branch paths is not above said plural pressure chambers, and is narrow at the place where each of said plural common ink branch paths is above said plural pressure chambers, corners of each of said pressure chambers are round corners, each of said ink supplying holes is positioned at the opposite side of each of said nozzles for each of said plural pressure chambers.

20. An ink jet recording apparatus, comprising:

an ink jet recording head as claimed in claim 19.

21. An ink jet recording head, comprising:

a nozzle plate being a resin film, in which nozzles for ejecting ink drops are formed;

a common ink path plate, in which a part of a common ink main path, plural common ink branch paths, and a part of connecting paths are formed;

an ink supplying plate, in which ink supplying holes, a part of said common ink main path, and a part of said connecting paths are formed;

a connecting path plate, in which a part of said main common path, a part of said connecting paths, and concave parts are formed; and a pressure chamber plate, in which plural pressure chambers, arrayed in a two-dimensional matrix, are formed, wherein:

said nozzle plate, said common ink path plate, said ink supplying plate, said connecting path plate, and said pressure chamber plate are layered from the top in the order mentioned above on a vibration plate, ink is supplied to each of said pressure chambers through said common ink main path, each of said plural common ink branch paths, each of said ink supplying holes, and each of said connecting paths, each of said pressure chambers ejects ink drops from each of said nozzles through each of said connecting paths by making pressure changes generate in each of said pressure chambers by a pressure generating means, wherein:

said ink supplying plate is made of a resin film whose thickness is 30 $\mu$m or less and also works as air dampers for said plural common ink branch paths, said ink supplying holes are formed by a laser process, said concave parts are formed on the surface facing said plural common ink branch paths through said ink supplying plate, on said connecting path plate, by having a shape matching with the shape of said plural common ink branch paths, and works as air dampers for said plural common ink branch paths, and said concave parts are connected to the outside air, said nozzle plate also works as air dampers for said plural common ink branch paths, each of said plural common ink branch paths is positioned in a state that each of said plural common ink branch paths is above some of said plural pressure chambers formed in said pressure chamber plate by placing said ink supplying plate between them, the width of each of said plural common ink branch paths is wide at the place where each of said plural common ink branch paths is not above said plural pressure chambers, and is narrow at the place where each of said plural common ink branch paths is above said plural pressure chambers, corners of each of said pressure chambers are round corners, walls of each of said pressure chambers have a round shape by applying both sides etching to said pressure chamber plate, walls of each of said plural common ink branch paths have a round shape by applying both sides etching to said common ink path plate, walls of each of said connecting paths have a round shape by applying both sides etching to said connecting path plate, and each of said ink supplying holes is positioned at the opposite side of each of said nozzles for each of said plural pressure chambers.

22. An ink jet recording apparatus, comprising:

an ink jet recording head as claimed in claim 20.

* * * * *